United States Patent [19]

Soliven

[11] 4,311,268

[45] Jan. 19, 1982

[54] FOOTWEAR BOX WITH HANDLES

[76] Inventor: Dante R. Soliven, 129 Esteban Abada St., Loyola Heights, Quezon City, Philippines

[21] Appl. No.: 183,577

[22] Filed: Sep. 2, 1980

[51] Int. Cl.[3] ..... B65D 5/38; B65D 13/06; B65D 5/46

[52] U.S. Cl. ..... 229/9; 229/52 B

[58] Field of Search ..... 229/9, 52 B

[56] References Cited

U.S. PATENT DOCUMENTS

| | | | |
|---|---|---|---|
| 1,165,638 | 12/1915 | Thomas | 229/9 |
| 1,670,036 | 5/1928 | Hirsch | 229/52 B |
| 1,953,885 | 4/1934 | McAleer | 229/52 B |
| 1,956,619 | 5/1934 | McAleer | 229/52 B |
| 2,078,455 | 4/1937 | Peters | 229/52 B |
| 2,153,334 | 4/1939 | Lowey | 229/52 B X |
| 2,663,491 | 12/1953 | Hill et al. | 229/52 B X |
| 3,005,546 | 10/1961 | Sanford | 229/52 B X |
| 4,171,763 | 10/1979 | Card | 229/52 B |

FOREIGN PATENT DOCUMENTS

| | | | |
|---|---|---|---|
| 1008399 | 2/1952 | France | 229/52 B |
| 1471191 | 1/1967 | France | 229/9 |
| 802466 | 10/1958 | United Kingdom | 229/52 B |
| 889718 | 2/1962 | United Kingdom | 229/52 B |

*Primary Examiner*—Herbert F. Ross

[57] ABSTRACT

Opposite sides of an oblong cardboard box have flap extensions at one end which can either be extended to form a pair of handles or bent downwardly, one flatwise on top of the other, and interlocked to form a locked flat end closure.

5 Claims, 4 Drawing Figures

FOOTWEAR BOX WITH HANDLES

FIELD OF INVENTION

Paper Receptacles, Handles, Integral.

OBJECTS

This invention relates generally to packaging and more particularly to a packaging box or container made of cardboard which is provided with a carrying folding handle to facilitate ease and convenience in carrying and closing said box. The packaging box is designed to contain shoes or other consumer articles.

Generally stated, the invention contemplates the provision of folding handles at one end of a box body formed of double plies of cardboard integral with opposite sides of the box.

More specifically, the invention contemplates such a folding handle having a wide grip area formed by die cut elongate slots which provide access for fingers to grip the handle flap while in carrying position. The folding handle can be bent down flush flatwise across the top end of the box and locked down, inserting corners of one handle flap into slanting slits near the base portion of the other handle flap, thereby serving to lock the handle flaps down to form a closed end cover. This feature permits the boxes to be stacked endwise, one on top of the other, or disposed sidewise closely adjacent to one another, with the end of one flatwise against the end of the other.

It is, therefore, the principal object of this invention to provide a novel, simple and cheap packaging box or container made of cardboard where said box is provided with a carrying folding handle which is an integral part.

Another object of this invention is to provide a packaging box or container with folding handles which also serve as a locked end closure, the cover and/or folding handle being an integral part of the box sides.

Still another object of the invention is to provide an inner drawer box for the footwear, one end of which serves as a back-up member for the handle flaps when the latter are folded down and locked together to form an end closure for the box.

Figure 1:
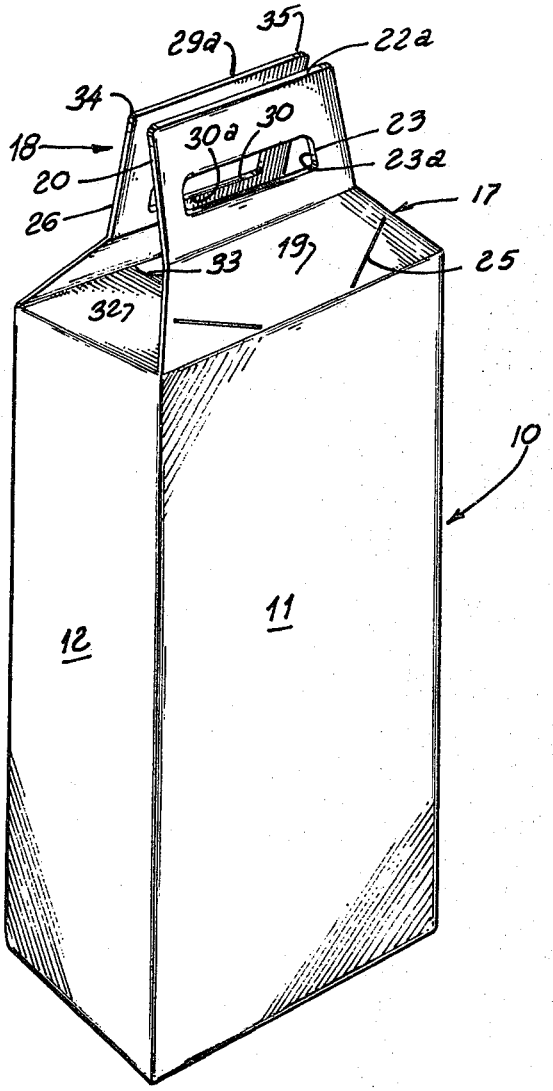
Figure 2:
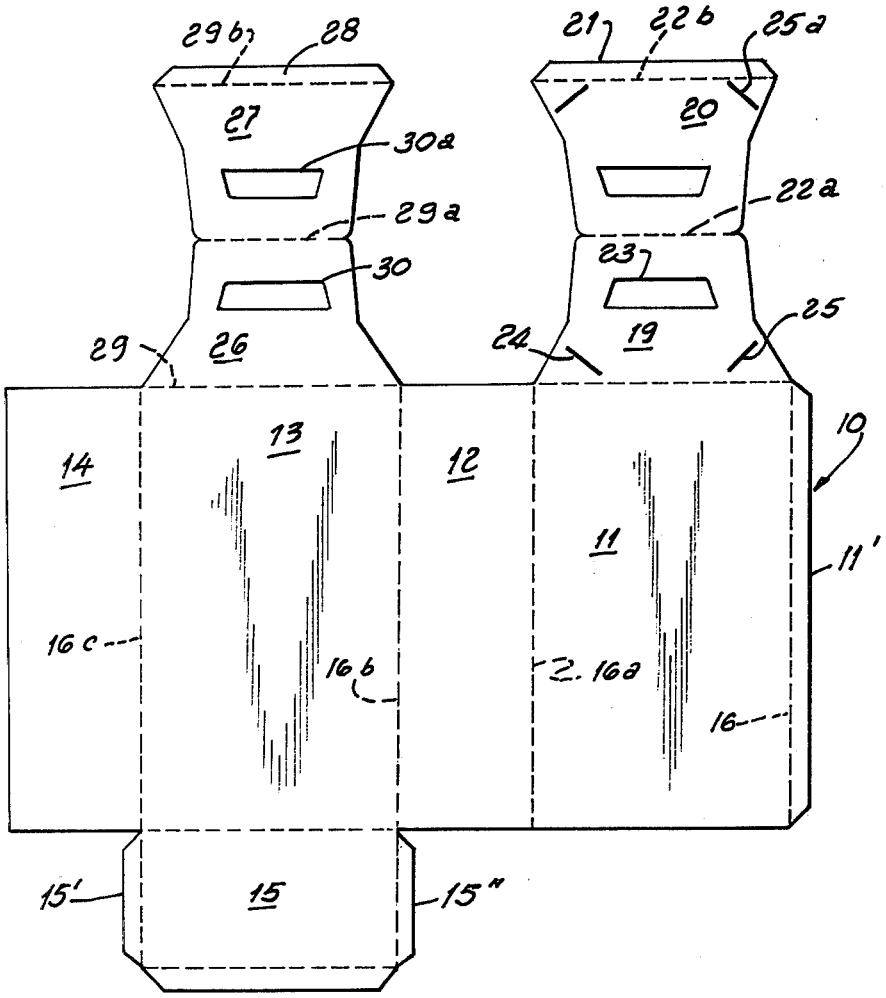
Figure 3:
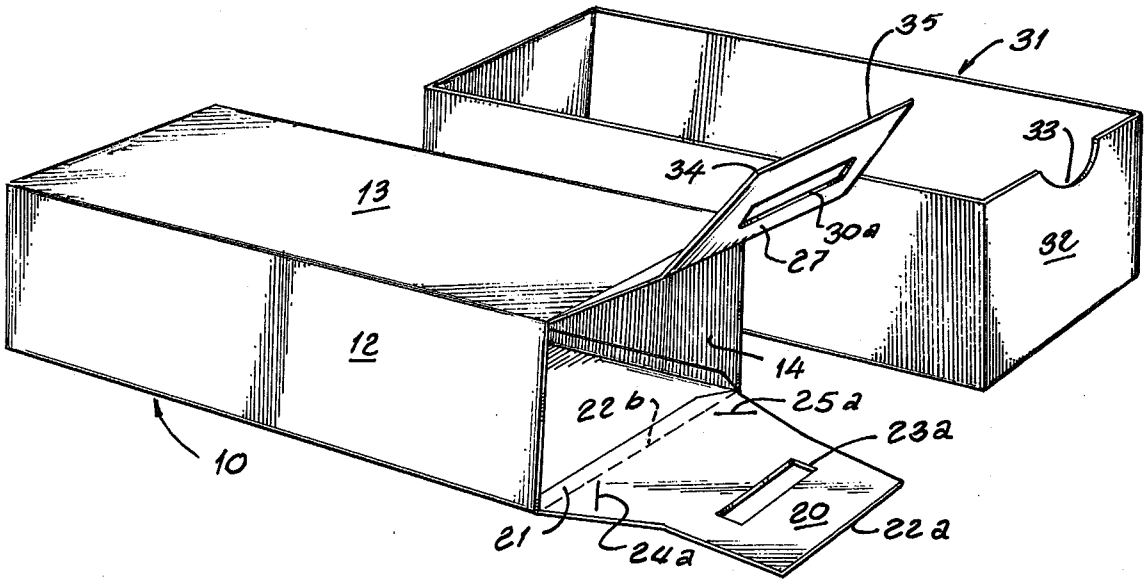
Figure 4:
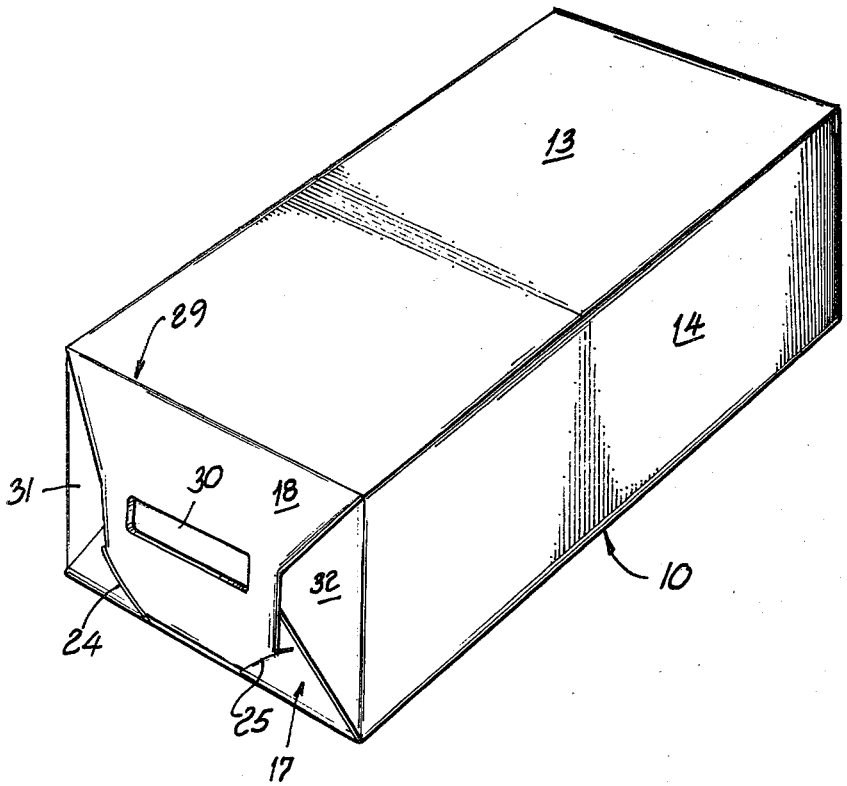

Other objects and advantages inherent in the simple yet novel construction of this invention will be understood more clearly from the following specification reference being made to the drawings forming parts thereof in which:

FIG. 1 is a perspective view of the fully assembled packaging box provided with a carrying folding handle in its raised position, FIG. 2 is a plan view of the blank form which the box of FIG. 1 is made, FIG. 3 is the perspective view showing separate packaging containers, the packaging box with open cover or folding handles and the inner drawer box, FIG. 4 is the perspective view of the packaging box with the folding handle closed and locked.

Referring now to the drawings, in which line reference numerals denote similar elements, there is shown the box generally designated as 10. Said box 10 is oblong, has four rectangular side panels 11, 12, 13 and 14, a bottom end panel 15, double ply handles 17 and 18, with elongated slots 23 and 30 made by die cutting. Slanting slits 24 and 25 are provided at the base portion of the handle 17.

Side 11 is provided with a glue tab 11$^{1}$ along the longitudinal side thereof and is provided with adhesive for binding it to side 14.

As is shown in FIG. 2, the packaging box 10 is made from a single integral blank of cardboard or the like stiff but bendable material, consisting of a number of panels (each of which becomes a confining wall of the final carton) and flaps. Handles 17 and 18 are double ply flaps extending from panels 13 and 11, respectively. Handle 17 is formed on one ply 19 and another ply 20 having glue tab 21 thereon. The ply 19 of handle 17 is integral with panel 11, being joined thereto by a crease line 22. At the juncture of plies 19 and 20 is a crease line **22*a*, and a crease line 22*b* is at the juncture of ply 20 and glue tab 21. Finger slots 23, 23*a* are die cut in both plies 19 and 20. Diagonal slits 24 and 25 are disposed in ply 19 adjacent the juncture thereof with panel 11 and corresponding diagonal slits 24*a* and 25*a* are disposed in ply 20. When ply 20 is lapped under ply 19 by bending along crease line 22*a* and glue tab 21 is secured against panel 11, finger slots 23 and 23*a* register with one another as does slit 24 with slit 24*a* and slit 25 with slit 25*a***.

Handle 18 is virtually identical to handle 17 except in that it need not have slits corresponding to the diagonal slits 24, **24*a*, 25 and 25*a* in handle 17. Handle 18 is formed of a one ply 26, another ply 27 with a glue tab 28 thereon, crease lines 29, 29*a* and 29*b* and finger slots 30 and 30*a***.

The box shown in FIGS. 1, 3 and 4 is formed by folding the blank of FIG. 2 along crease lines 16, **16*a*, 16*b*, and 16*c* and securing glue tab 11$^{1}$ to panel 14, and glue tabs 15$^{1}$, 15$^{11}$ and 15$^{111}$ against panels 14, 11 and 12, respectively. The handles 17 and 18** are folded, bent down and secured as previously described.

Best shown in FIG. 3 is a drawer box 31 having an end wall 32 with a finger notch 33 in its upper end. When the upper end of box 10 is open, as in FIG. 3, drawer box 31 can be slidingly engaged therein. If the assembly of boxes 10 and 31 is to be carried, the handles 17 and 18 are left erect, as in FIG. 1. However, if the box is to be closed, as in FIG. 4, handle 17 is bent down along crease line 22 so that it lies flat against the end 32 of drawer box 31, handle 18 is bent downwardly along crease line 29, its corners 34 and 35 are inserted into slots 24 and 25, and handle 18 is pressed flat against handle 17. In this condition, the handles 17 and 18 constitute flat end closures, interlocked with one another, and the end 32 of drawer box 31 constitutes a back-up for the locked handles.

What is claimed is:

1. Combined handle and locked end closure means for a box formed of cardboard or the like stiff but bendable sheet material and having opposed pairs of side walls, comprising a pair of end flaps respectively integral with and extending outwardly from corresponding ends of one opposed pair of side walls, said end flaps each having a base portion adjacent the side wall from which it extends and an outer end portion remote from said side wall, the outer end portions of said flaps each having a finger slot therein whereby said end flaps serve as handle means when erected outwardly beyond said side walls, the base portion of one of said end flaps having slit means therein adopted to receive parts of the outer end portion of the other flap, whereby said end flaps serve as locked end closed means for the box when the same are bent inwardly one under the other and the outer end portion of the other flap is inserted in said slit means.

2. Combined handle and end closure means as claimed in claim 1, said slit means being comprised of a pair of diagonal slits having inner end portions disposed adjacent the side wall from which said one flap extends, and divergent outer end portions disposed relatively remote from said panel and spaced inwardly from the edges of said one flap.

3. Combined handle and end closure means as claimed in claim 2, the parts of the outer end portion of said other flap being comprised of a pair of corner portions.

4. Combined handle and end closure means for a box as claimed in claim 1, said end flaps being constituted by two plies, one ply being bent back flatwise upon the other, the slit means in the base portion of said one flap extending through both of the plies thereof.

5. Combined handle and end closure means as claimed in claim 1, and a drawer box slidably engaging in the first mentioned box, said drawer box having a flat end wall disposed behind and against said flaps when the latter are bent inwardly and locked closed, whereby said end wall constitutes back-up means for said flaps.

* * * * *